US006189651B1

(12) United States Patent
Sadeck

(10) Patent No.: US 6,189,651 B1
(45) Date of Patent: Feb. 20, 2001

(54) HARNESS FOR HUMAN WEAR

(75) Inventor: James E. Sadeck, East Freetown, MA (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/334,981

(22) Filed: Jun. 17, 1999

Related U.S. Application Data

(63) Continuation of application No. 09/110,362, filed on Jul. 6, 1998, now abandoned, which is a continuation-in-part of application No. 08/819,577, filed on Mar. 14, 1997, now Pat. No. 5,857,540.

(51) Int. Cl.[7] ..... A62B 35/00
(52) U.S. Cl. ..... 182/6; 182/3
(58) Field of Search ..... 182/3, 6, 7

(56) References Cited

U.S. PATENT DOCUMENTS 4,076,101 * 2/1978 Himmelrich ..... 182/3

FOREIGN PATENT DOCUMENTS

1966239 * 1/1972 (DE) ..... 182/3
3604973 * 8/1987 (DE) ..... 182/6
2530151 * 1/1984 (FR) ..... 182/3

* cited by examiner

*Primary Examiner*—Alvin Chin-Shue
(74) *Attorney, Agent, or Firm*—Vincent J. Ranucci

(57) ABSTRACT

A harness for human wear comprises an elongated belt for encircling a waist of a wearer. A first strap is fixed to the belt and is extendible transversely of the belt from a lower edge of the belt, the first strap having a connector at a free end thereof. A second strap is fixed to the belt and is extendible transversely of the belt from the lower edge of the belt, the second strap having a connector at a free end thereof. First and second ends of the belt are connectable together, and the strap connectors are movable to a generally common point for engagement with a single loop member mounted on the belt.

3 Claims, 6 Drawing Sheets

HARNESS FOR HUMAN WEAR

CROSS-REFERENCE TO RELATED APPLICATION

This application is a continuation of application Ser. No. 09/110,362, filed on Jul. 6, 1998, abandoned, which in turn is a continuation-in-part of application Ser. No. 08/819,577 filed on Mar. 14, 1997, U.S. Pat. No. 5,859,540, Jan. 12, 1999.

STATEMENT OF GOVERNMENT INTEREST

The invention described herein may be manufactured, used and licensed by or for the Government for Governmental purposes without the payment to us of any royalty thereon.

BACKGROUND OF THE INVENTION (1) Field of the Invention

This invention relates to a harness for human wear, and is directed more particularly to a harness for use as an emergency egress/descent harness and as a safety restraint.

(2) Description of the Prior Art

Harnesses available for egress/descent, and as safety restraints, typically are either full body harnesses or single-strap belts having a load ring thereon. The former are not in favor among sport climbers, fire fighters, bridge workers, special weapons and tactics teams, and the like, because of the inconvenience of donning the harness and the interference of the harness with the other gear or weapons carried by the wearer. Those who have need of such devices often elect not to carry them, taking a chance that an emergency situation requiring their use will not arise. The latter are preferred because of the ease of use and lack of interference with other equipment borne by the wearer, and because since a belt is customarily worn anyhow, one need not be carried and donned in emergency situations. However, putting a load ring on a belt at any point causes the body weight to be supported only at the waist.

Accordingly, there is a need for a belt which encounters little resistance to wear, and which, when circumstances warrant, is readily converted to a harness affording waist and leg support.

SUMMARY OF THE INVENTION

In view thereof, an object of the invention is to provide a harness for human wear which in one mode constitutes a belt for wear around the waist of a human, and, in another mode constitutes a harness providing waist and leg support.

With the above and other objects in view, as will hereinafter appear, a feature of the present invention is the provision of a harness for human wear comprising an elongated belt for encircling a waist of a wearer. A first strap is fixed to the belt and is extendible transversely of the belt with a longer portion of the first strap extending from a lower edge of the belt and a shorter portion of the first strap extending from an upper edge of the belt, the first strap having loops at each end thereof. A second strap is fixed to the belt and is extendible transversely of the belt with a longer portion of the second strap extending from the lower edge of the belt and a shorter portion of the second strap extending from the upper edge of the belt, the second strap having loops at each end thereof. First and second ends of the belt are connectable together, and the loops are adapted for disposal at a generally common point for engagement with a single connector member.

In accordance with a further feature of the invention, there is provided a harness for human wear comprising an elongated belt for encircling a waist of a wearer. A first strap is fixed to the belt and is extendible transversely of the belt, the first strap extending from a lower edge of the belt and having first connector means at a free end thereof. A second strap is fixed to the belt and is extendible transversely of the belt, the second strap extending from the lower edge of the belt and having second connector means at a free end thereof. The strap end connector means are adapted for disposal at a generally common point for engagement with a single loop member mounted on the belt.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

and

Figure 4:
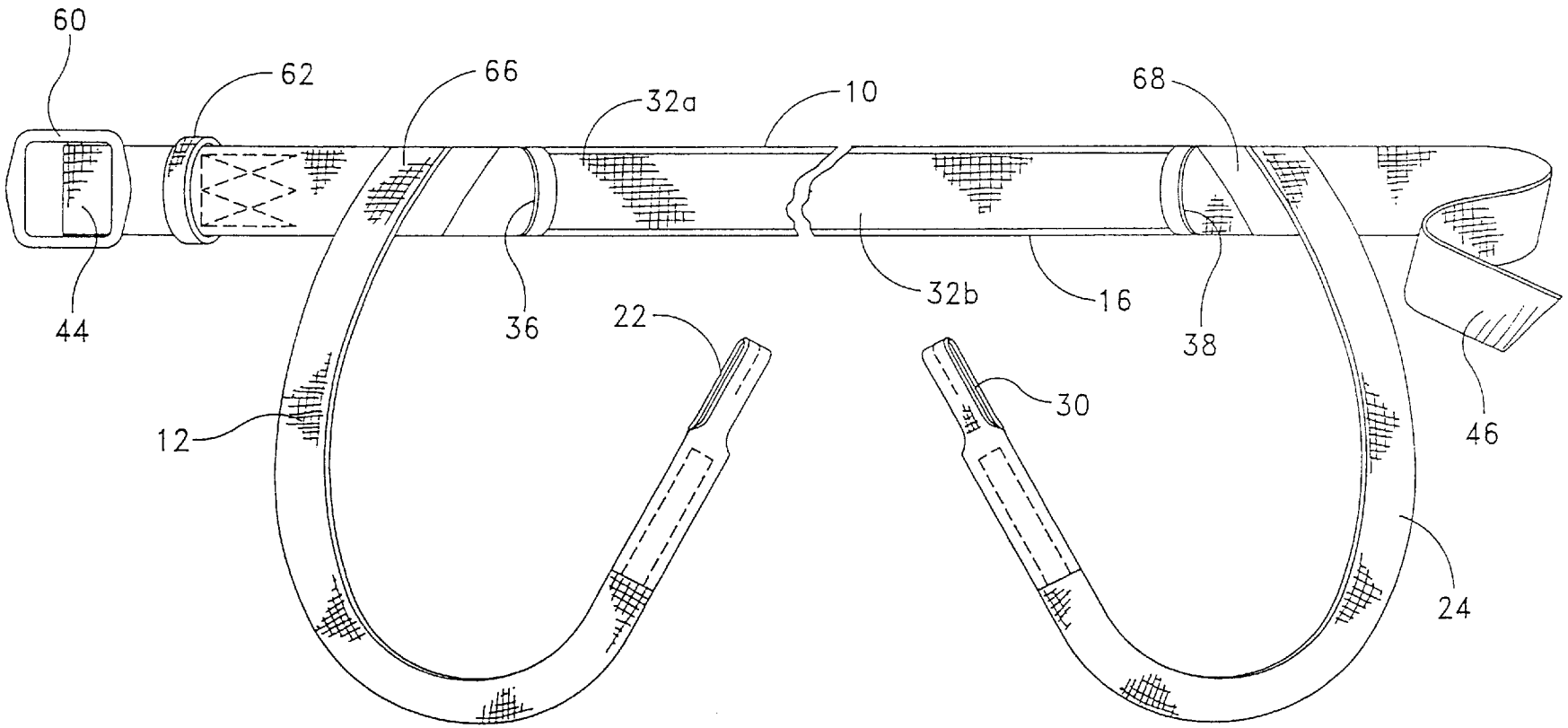
FIG. 4 is a generally front elevational view, partly in perspective, of another form of harness illustrative of an alternative embodiment of the invention, the harness being shown in a first mode.
Figure 6:
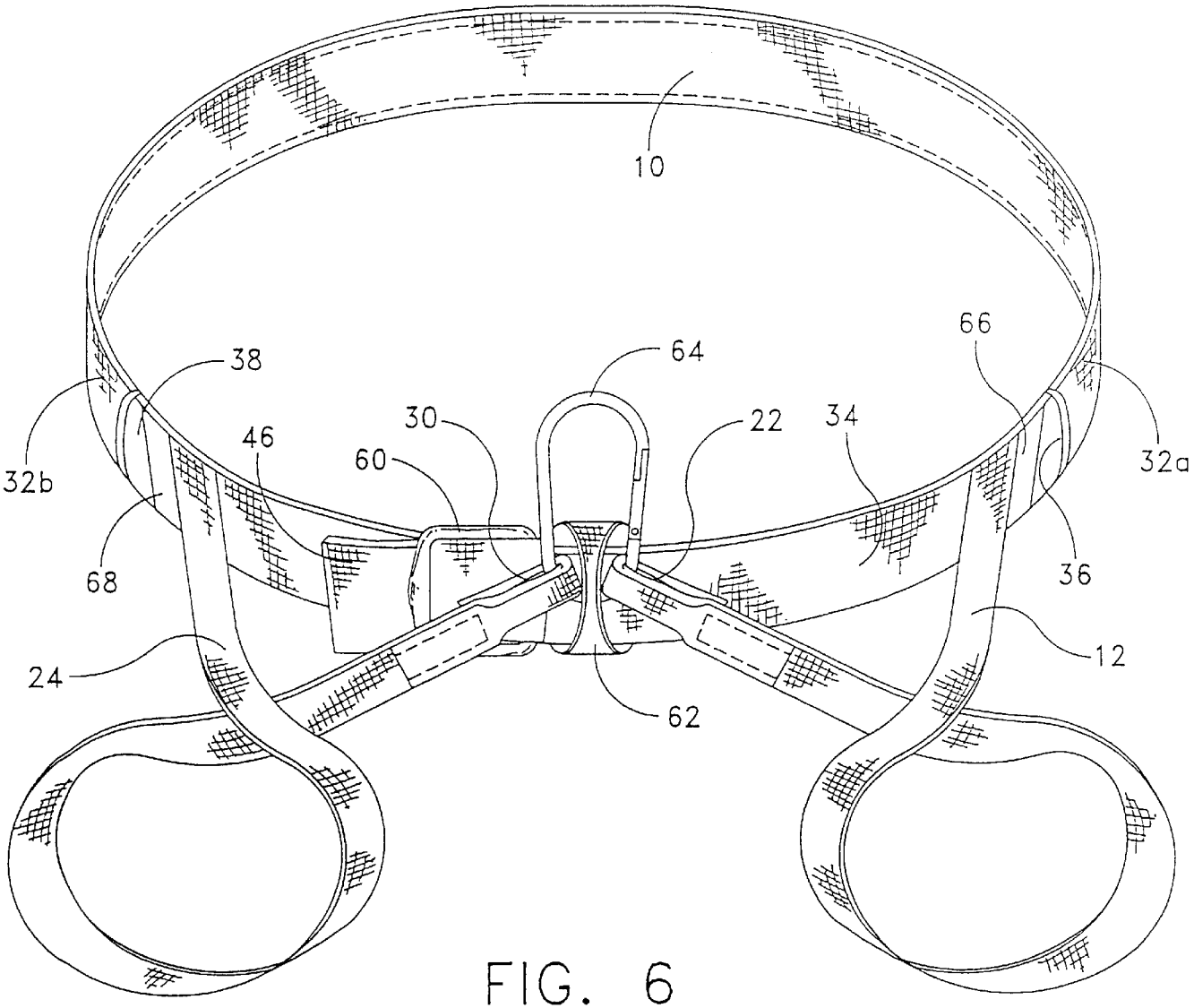

FIG. 6 is a perspective view of the harness of FIG. 4 shown in a configuration for use.

DESCRIPTION OF THE PREFERRED EMBODIMENTS

Figure 1:
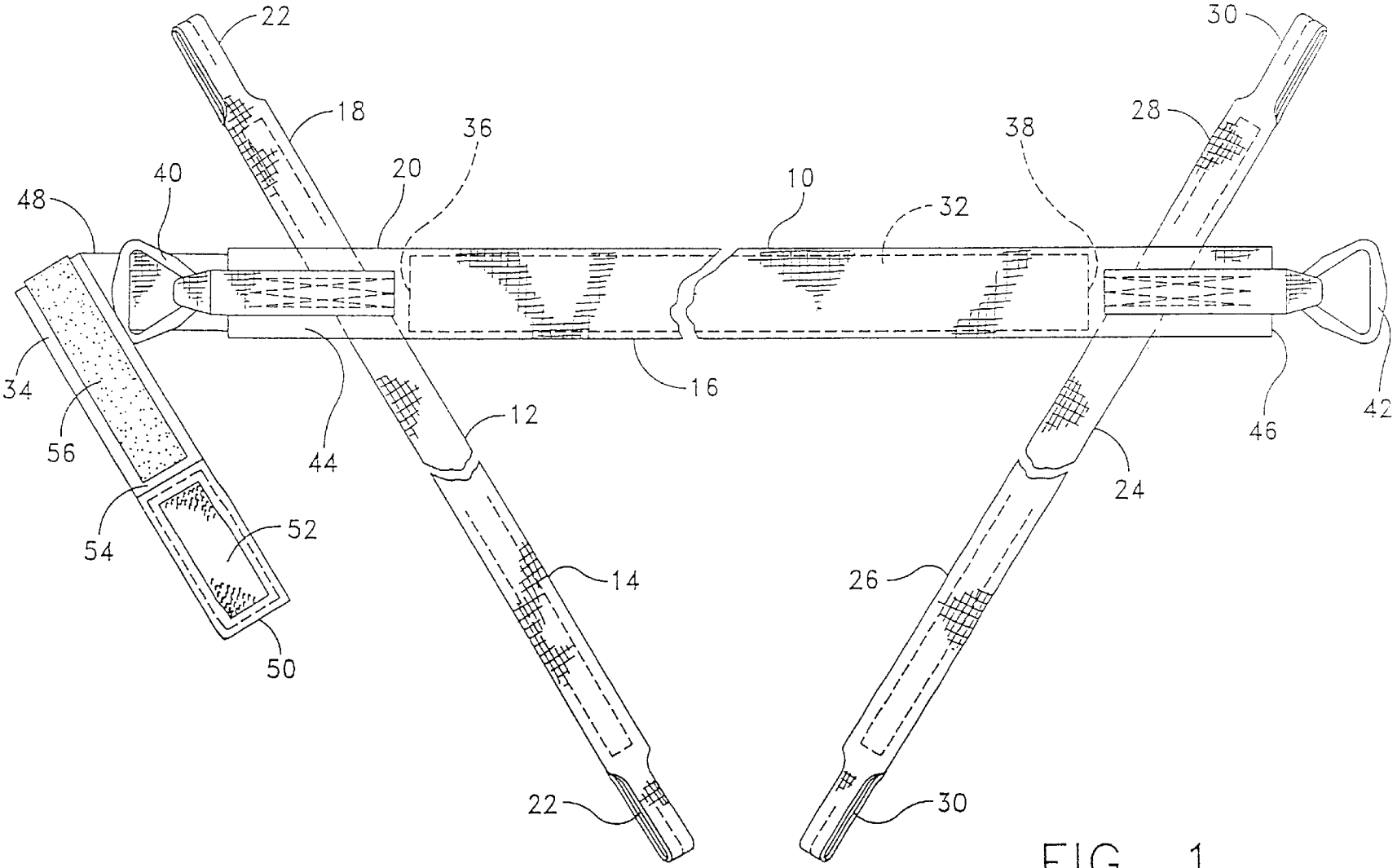
FIG. 1 is a generally front elevational view, partly in perspective, of one form of harness illustrative of an embodiment of the invention, the harness being shown in a first mode.

Referring to FIG. 1, it will be seen that the illustrative harness includes an elongated belt 10 for encircling a waist of a wearer. The belt 10 preferably is of a high-strength nylon webbing, but may be of any suitably strong and flexible material. A first strap 12 is fixed to the belt 10, as by stitching, and is extendible transversely of the belt 10. A longer portion 14 of the strap 12 extends from a lower edge 16 of the belt 10, and a shorter portion 18 of the strap 12 extends from an upper edge 20 of the belt 10. The strap longer portion 14 and shorter portion 18 are each provided with a loop 22 at the end thereof.

Similarly, a second strap 24 is fixed to the belt 10 and is extendible transversely of the belt 10 with a longer portion 26 of the second strap 24 extending from the lower edge 16 of the belt 10, and a shorter portion 28 of the second strap 24 extending from the upper edge 20 of the belt 10. The second strap longer portion 26 and shorter portion 28 are each provided with a loop 30 at the end thereof.

Referring still to FIG. 1, it will be seen that an open-ended elongated pocket 32 is fixed to an outside surface 34 of the belt 10 and is configured to receive at a first open end 36 the longer and shorter portions 14, 18 of the first strap 12, and is configured to receive at a second open end 38 the longer and shorter portions 26, 28 of the second strap 24. Thus, the straps 12, 24 may be substantially entirely stowed in the pocket 32, as is illustrated in FIG. 2.

To facilitate the stowage of the straps 12, 24 in the pocket 32, the first strap 12 is fixed to the belt 10 proximate the first open end 36 of the pocket 32, with the pocket open end 36 being adapted to receive the first strap longer and shorter portions 14, 18. Similarly, the second strap 24 is fixed to the belt 10 proximate the second open end 38 of the pocket 32, with the pocket open end 38 being adapted to receive the second strap longer and shorter portions 26, 28.

Figure 2:
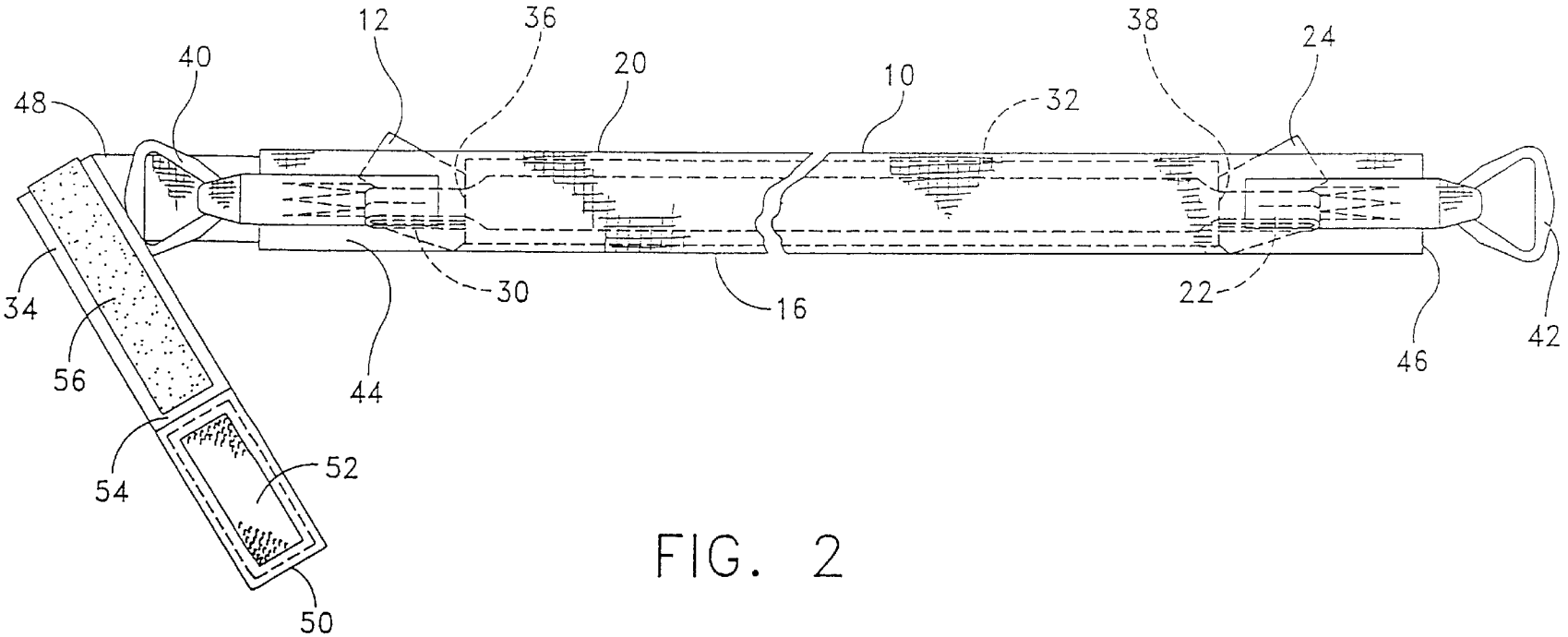
FIG. 2 is a generally front elevational view, partly in perspective, of the harness of FIG. 1, shown in a second mode.
Figure 3:
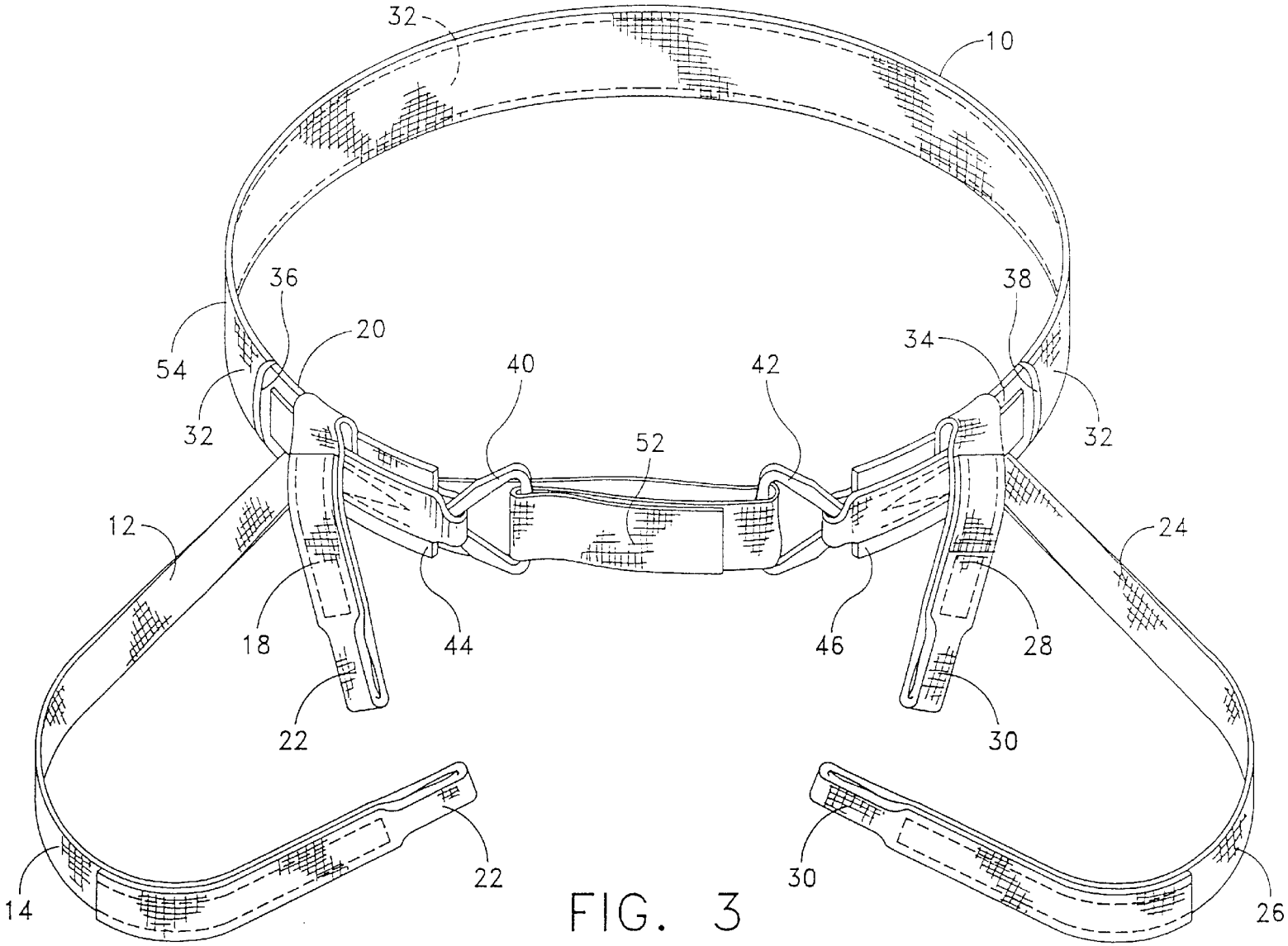
FIG. 3 is a perspective view of the harness of FIG. 2 shown in a configuration for use.

Referring to FIGS. 1–3, it will be seen that the belt 10 is provided with first and second loop fittings 40, 42 fixed to, respectively, first and second belt ends 44, 46. At the belt first end 44 there is fixed an elongated extension 48 having on an outside portion 54 thereof, proximate a free end 50 thereof, a first connector 52, such as a hook or pile connector, and further having on the outside portion 54 thereof a second connector 56 complementary to the first connector 52. The extension 48 is extendible through the second loop fitting 42 and, thereafter, through the first loop fitting 40. The first and second connectors 52, 56 are then engaged with each other between the loop fittings 40, 42 (FIG. 3) to close the belt 10. The belt 10 may be provided with a load ring (not shown) either sewn into the belt or loosely riding on the belt.

The strap end loops 22, 30 may be gathered in one location for acceptance of a D-ring, hook, rope or cable, snap fastener, and the like (not shown).

Referring to FIG. 4, it will be seen that in an alternative embodiment the previously described loop fittings 40, 42 and elongated extension 48 are replaced with a more traditional hard belt buckle 60 fixed to the belt first end 44 and adapted to receive and connect to the belt second end 46.

Further, the first and second straps 12, 24 extend only from the lower edge 16 of the belt 10, and are connected to the belt 10 so as to incline outwardly from the belt, as shown in FIG. 4, rather than inwardly, as shown in FIG. 1. The straps 12, 24 of the embodiment shown in FIG. 4 are each provided with only one end loop 22, 30.

Still further, a web ring 62, or the like, is mounted on the belt 10 proximate the belt first end 44 for receiving and retaining a carabiner 64 (FIG. 6), or the like, as will be further discussed hereinbelow.

As shown in FIG. 4, anchored ends 66, 68 of the straps 12, 24 may be wound around the belt 10 and multi-stitched to provide secure fixation to the belt.

Figure 5:
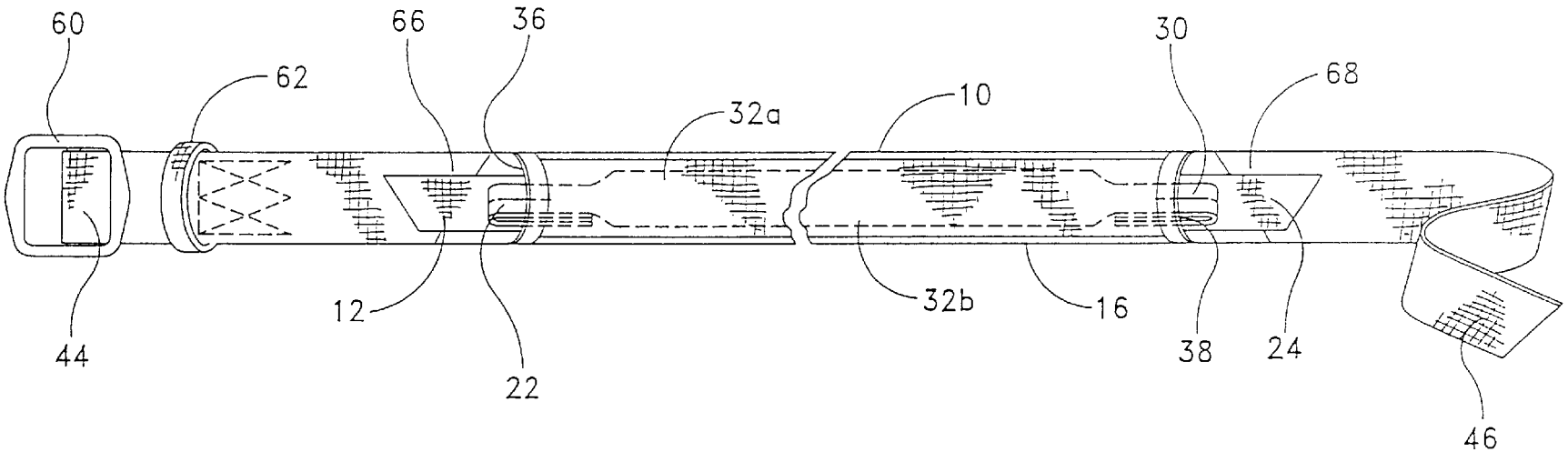
FIG. 5 is a generally front elevational view, partly in perspective, of the harness of FIG. 4, shown in a second mode.

The belt 10 shown in FIGS. 4 and 5 preferably is provided with two pockets 32*a*, 32*b*, with the respective open ends 36, 38. When the belt 10 is worn as a belt, or is stored, the strap 12 is housed in the pocket 32*a* and the strap 24 is housed in the pocket 32*b* (FIG. 5), preferably with the loops 22, 30 slightly exposed so as to be easily grasped by the wearer when use of the straps 12, 24 is desired.

In operation, the carabiner 64 is fixed in the web ring 62 (FIG. 6). The straps 12, 24 are pulled from their respective pockets 32*a*, 32*b* (FIG. 4) and looped (FIG. 6) around the wearer's legs (not shown) and extended to a generally common point coincident with the carabiner 64. The carabiner 64 is opened, the loops 22, 30 slid onto the carabiner, and the carabiner is locked closed so as to secure the strap loops 22, 30 to the carabiner.

It will be apparent that in the embodiment of FIGS. 4–6, the straps 12, 24 are substantially shorter than in the embodiment of FIGS. 1–3 and are therefore more easily inserted into the pockets 32*a*, 32*b*, and permit the pockets to be flatter, more flexible, and more comfortable when the device is worn as a belt, rather than a harness.

Thus, a wearer may don what is essentially a belt, serving the same purposes as a simple belt, such as holding up trousers, and the like, and which is unobtrusive and comfortable to wear, but which may, in seconds, be converted easily into a harness by which one may be restrained, lifted, conveyed, etc., utilizing waist and leg support.

It is to be understood that the present invention is by no means limited to the particular constructions herein disclosed and/or shown in the drawings, but also comprises any modifications or equivalents within the scope of the claims.

What is claimed is:

1. A harness for human wear, said harness comprising:

an elongated belt for encircling a waist of a wearer;

a first strap having an end fixed at an inclined angle to said belt and extendible transversely of said belt from a lower edge of said belt, said first strap having a loop at a free end thereof; and a second strap having an end fixed at an inclined angle to said belt and extendible transversely of said belt from said lower edge of said belt, said second strap having a loop at a free end thereof;

said first strap being connected to said belt to incline outwardly from said belt and from said second strap, and said second strap being connected to said belt to incline outwardly from said belt and from said first strap;

a single loop member mounted on said belt;

said loops being adapted for disposal at a substantially common point for engagement with said single loop member mounted on said belt;

a web rind mounted on said belt and adapted to receive and retain said single loop member;

said loops engaging said single loop member, and said web ring engaging said single loop member, whereby said loops, said single loop member and said web ring are disposed at a substantially common point for engagement with said belt; and elongated pocket means fixed to a surface of said belt and configured to receive said first and second straps, wherein said pocket means comprises first and second pockets, and said first strap is fixed to said belt proximate an open end of said first pocket, said first pocket being adapted to receive said first strap, and said second strap is fixed to said belt proximate an open end of said second pocket, said second pocket being adapted to receive said second strap.

2. The harness in accordance with claim 1 wherein said single loop member comprises a carabiner.

3. The harness in accordance with claim 1 wherein said first strap is of a sufficient length to encircle a first leg of the wearer and position said first strap free end loop coincident with said single loop member, and said second strap is of a sufficient length to encircle a second leg of the wearer and position said second strap free end loop coincident with said single loop member.

* * * * *